US009060668B2

(12) United States Patent
Kim et al.

(10) Patent No.: US 9,060,668 B2
(45) Date of Patent: Jun. 23, 2015

(54) CONTROLLING METHOD OF DISHWASHER

(75) Inventors: Seong Ho Kim, Seoul (KR); Yong Jin Choi, Seoul (KR); Young Hwan Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 658 days.

(21) Appl. No.: 12/461,683

(22) Filed: Aug. 20, 2009

(65) Prior Publication Data

US 2010/0043829 A1 Feb. 25, 2010

(30) Foreign Application Priority Data

Aug. 21, 2008 (KR) ..... 10-2008-0081794

(51) Int. Cl.

| | |
|---|---|
| ***A47L 15/46*** | (2006.01) |
| ***B08B 9/20*** | (2006.01) |
| ***A47L 15/42*** | (2006.01) |
| ***A47L 15/00*** | (2006.01) |

(52) U.S. Cl.

CPC ..... *A47L 15/4287* (2013.01); *A47L 15/0005* (2013.01); *A47L 15/0007* (2013.01); *A47L 15/0015* (2013.01); *A47L 15/0049* (2013.01); *A47L 15/4234* (2013.01); *A47L 2401/12* (2013.01); *A47L 2501/06* (2013.01); *A47L 2601/04* (2013.01)

(58) Field of Classification Search

CPC ..... A47L 15/0005; A47L 15/0026; A47L 2401/12; A47L 15/0007; A47L 15/0015; A47L 15/0049; A47L 15/4234; A47L 15/4287; A47L 2501/06; A47L 2601/04

USPC ..... 134/25.1, 25.2, 57 D, 58 D

See application file for complete search history.

(56) References Cited

U.S. PATENT DOCUMENTS

| | | | | |
|---|---|---|---|---|
| 3,049,133 | A * | 8/1962 | Jacobs | 134/57 D |
| 4,159,211 | A * | 6/1979 | Hoffman et al. | 134/57 D |
| 5,803,985 | A * | 9/1998 | Alvord | 134/18 |
| 6,422,180 | B1 * | 7/2002 | Yiu | 122/404 |
| 7,189,947 | B2 * | 3/2007 | Fulton | 219/490 |
| 2007/0151578 | A1 * | 7/2007 | Cho et al. | 134/18 |
| 2007/0235063 | A1 * | 10/2007 | Lee et al. | 134/25.2 |
| 2007/0246073 | A1 * | 10/2007 | Kang | 134/18 |

FOREIGN PATENT DOCUMENTS

| | | | |
|---|---|---|---|
| CN | 1973750 | A | 6/2007 |
| CN | 101069631 | | 11/2007 |
| CN | 101152070 | A | 4/2008 |
| CN | 101161177 | A | 4/2008 |

(Continued)

*Primary Examiner* — Michael Kornakov
*Assistant Examiner* — Douglas Lee
(74) *Attorney, Agent, or Firm* — McKenna Long & Aldridge LLP

(57) ABSTRACT

Dishwashers and methods of control for operation of dishwashers are disclosed. The dishwasher may include an upper rack in an upper portion of a washing compartment for placing dishes, such as wine glasses, which are susceptible to damage. The dishwasher may also include an upper spraying arm in the upper portion of the washing compartment. During a wash cycle, the upper spraying arm can spray washing water toward the upper rack and steam may be supplied to the washing compartment at various intervals to reduce the risk of damage to the dishes and improve foreign matter removal. During a rinse cycle, water which may be heated in multiple stages by a sump heater may be sprayed toward the upper rack.

10 Claims, 3 Drawing Sheets

(56) References Cited

FOREIGN PATENT DOCUMENTS

| | | | |
|---|---|---|---|
| JP | 2006-320440 | A | 11/2006 |
| JP | 2008-012042 | A | 1/2008 |
| KR | 10-2007-0078118 | A | 7/2007 |
| KR | 1020070100554 | A | 10/2007 |
| WO | WO 2006/037447 | A1 | 4/2006 |

* cited by examiner

CONTROLLING METHOD OF DISHWASHER

CROSS REFERENCE TO RELATED APPLICATION

This application claims the benefit of Korean Patent Application No. 10-2008-0081794, filed on Aug. 21, 2008, which is hereby incorporated by reference as if fully set forth herein.

BACKGROUND OF THE DISCLOSURE

1. Field of the Disclosure

The present disclosure generally relates to dishwashers. In particular, the present disclosure relates to controls for a dishwasher that washes dishes with surfaces that are susceptible to damage.

2. Discussion of the Related Art

A conventional dishwasher is a machine which sprays washing water on dishes placed in a tub to remove foreign matter, such as food scraps left on the dishes. Generally, the dishwasher is operated based on a washing cycle which sprays washing water mixed with detergent in a tub that contains dishes, in order to remove foreign matter left on the dishes. The dishwasher may also heat the washing water to improve performance. Typically, after the washing cycle, a rinsing cycle occurs which sprays washing water that is not mixed with the detergent in the tub to remove any remaining foreign matter. After the washing cycle, a drying cycle takes place which dries the dishes.

Typically, more than one spraying arm and at least one rack (for placing dishes which need to be washed) are provided in a single tub of the conventional dishwasher. For example, a dishwasher usually has an upper rack and a lower rack in a bi-level configuration within the tub. A number of holders are then provided on the upper rack which hold small dishes, such as small cups with a small washing load, and a smaller number of holders are provided on the lower rack which hold large dishes, such as dinner dishes or large bowls with a larger washing load. An upper spraying arm and a lower spraying arm are then provided which spray washing water at the upper and lower racks, respectively.

Unfortunately, the conventional configuration of a dishwasher has many drawbacks related to washing many dishes, such as a wine glass. When a wine glass is washed by human hands, there is a significant risk of damage to surfaces of the glass. Unfortunately washing the wine glass in a conventional dishwasher offers little improvement, as scratches on the surfaces of the glass often result from spraying a mixture of washing water and detergent. These scratches give an unpleasant feeling to a user of the glass and reduce the life span of the glass. In addition, the conventional dishwasher typically does not remove spots on the glass which are heavily contaminated with foreign matter, such as wine stains, for example.

SUMMARY OF THE DISCLOSURE

The present disclosure is generally directed to dishwashers and methods of control and operation of the dishwashers. In some embodiments, sensitive dishes with washability issues, such as wine glasses that are susceptible to damage, can be washed more efficiently, effectively, and safely.

Advantages and features of the invention in part may become apparent in the description which follows and in part may become apparent to those having ordinary skill in the art upon examination of the following or may be learned from practice of the embodiments described herein. The advantages and features of the embodiments of the present invention may be realized and attained by the structures and processes described in the written description, the claims, and in the appended drawings.

To achieve these and other advantages and in accordance with the purpose of the present disclosure, as embodied and broadly described herein, a controlling method of a dishwasher including an upper rack, a sump configured to contain water, and an upper spraying arm configured to spray the water is provided. The method may include performing a washing cycle including spraying water to the upper rack by using the upper spraying arm provided in an upper portion of a washing compartment and supplying steam to the washing compartment, the spraying of the water and the supplying of the steam being repeated alternately; draining the washing water used in the washing cycle; supplying new clean water; and rinsing by spraying water, including the new clean water, from the sump to the upper rack.

The dishwasher may further include a sump heater configured to heat the water held in the sump, the sump heater may be turned off during the supplying of the steam in the performance of the washing cycle. In an embodiment, the supplying of the steam in the performance of the washing cycle may be repeated more than three times. In some embodiments, the supplying of the steam in the performance of the washing cycle may continue for 3 to 5 minutes at one time. In some embodiments, the sump heater may be operated for a predetermined time period during rinsing.

In exemplary embodiments, the sump heater may be controlled so that a temperature of the water used in the rinsing reaches a preset first temperature and a preset second temperature sequentially, the preset second temperature being higher than the preset first temperature. In some embodiments, the first temperature may be between 60° C. and 65° C. In some embodiments, the second temperature may be between 66° C. and 69° C. In some embodiments, an operation time of the rinsing may be longer than an operation time of the performing of the washing cycle.

In an embodiment, a controlling method of a dishwasher that may include a sump configured to contain water, a sump heater configured to heat the water, an upper spraying arm configured to spray the water from the sump, and an upper rack provided in an upper portion of a washing compartment are provided. The controlling method may include performing a washing cycle, including spraying water without detergent to the upper rack by using the upper spraying arm and supplying steam to the washing compartment, the spraying water and the supplying steam being repeated alternately; draining the washing water used in the performing of the washing cycle and supplying new water to the sump; and rinsing by spraying water heated by the sump heater toward the upper rack; and drying the washing compartment.

In the washing cycle, the sump heater may heat the supplied new water and any water remaining in the sump in two stages sequentially, the two stages having a preset first temperature as a first maximum temperature and a preset second temperature, higher than the preset first temperature, as a second maximum temperature. During rinsing, the temperature of the water can be heated until the preset first temperature is reached, then the temperature of the water may be allowed to decrease before being re-heated to the preset second temperature.

In a further aspect, a controlling method of a dishwasher including a washing compartment having a sump configured to contain water, an upper spraying arm configured to spray water from the sump, and an upper rack provided in an upper portion of the washing compartment, the controlling method may include performing a washing cycle including spraying water without detergent toward the upper rack by using the upper spraying arm and supplying steam to the washing compartment, the spraying water and the supplying steam being repeated alternately; and rinsing including heating water in two stages by using a sump heater and spraying the heated water toward the upper rack.

In the two stages of the rinsing, the water may be heated until the temperature of the water reaches a preset first temperature at which point the sump heater is turned off. After a predetermined time period, the water is re-heated until the temperature of the water reaches a preset second temperature, greater than the first temperature. In the two stages of the rinsing, the sump heater may be controlled to be turned on and off so that an increase-oblique of the temperature of the water while the sump heater is on is steeper than a decrease-oblique of the temperature of the water while the sump heater is turned off.

According to embodiments disclosed herein, sensitive dishes having fragile surfaces may be washed efficiently. For example, small dishes having a small washing load, such as wine glasses, may be washed without detergent.

It is to be understood that both the foregoing general description and the following detailed description are exemplary and explanatory and should not be construed as limiting the scope of the claims.

BRIEF DESCRIPTION OF THE DRAWINGS

The accompanying drawings are included to provide a further understanding of the disclosure, and are incorporated herein and constitute a part of this application. The drawings together with the description serve to explain exemplary embodiments of the present disclosure. In the drawings.

DESCRIPTION OF THE EMBODIMENTS

Reference will now be made in detail to the specific embodiments of the present disclosure, examples of which are illustrated in the accompanying drawings. Wherever possible, the same reference numbers will be used throughout the drawings to refer to the same or like parts.

Figure 1:
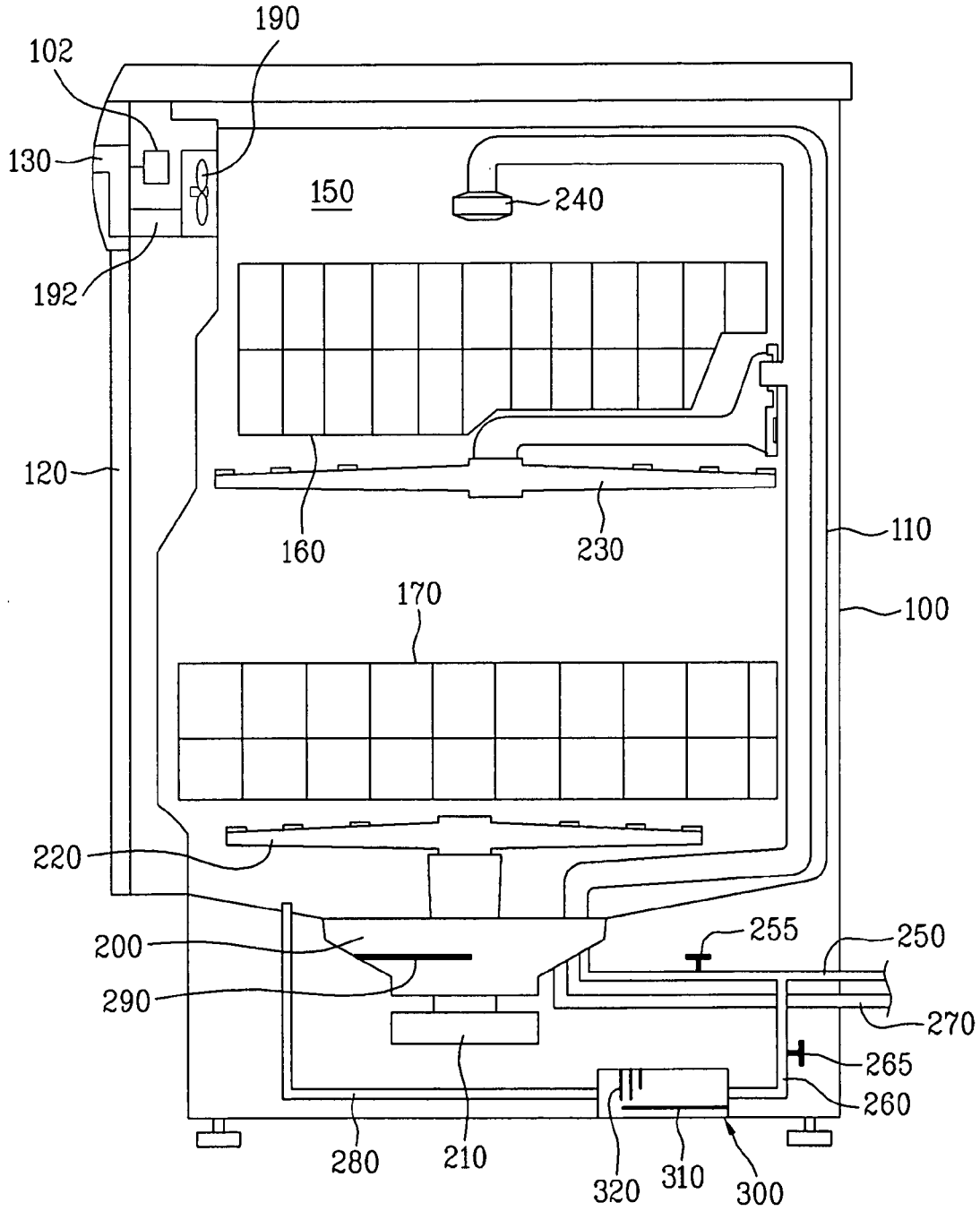
FIG. 1 illustrates a sectional view of a dishwasher and controls, according to an embodiment of the invention.

FIG. 1 depicts a sectional view of a dishwasher and controls, according to an embodiment of the invention. The dishwasher can include a case 100 which defines an exterior appearance, a door 120 for opening and closing the case 100, and a control panel 130 mounted on the case 100 or door 120 for operating the dishwasher. The case 100 may include a washing compartment 150 having a tub 110. Dishes can be placed in the washing compartment 150.

In an embodiment, a sump 200 that may contain washing water can be positioned under the tub 110. A pump 210 and a filter (not shown) can be provided in the sump 200. The pump 210 can pump the washing water held in the sump 200. The filter can advantageously filter contaminated water. In addition, a sump heater 290 may be provided in the sump 200 to heat water inside the sump 200.

With continued reference to FIG. 1, a first water supply pipe 250 and a water drain pipe 270 can be connected with the sump 200. New clean water may be drawn from an external water source through the first water supply pipe 250 and the washing water inside the sump 200 can be drained outside through the water drain pipe 270. A first water supply valve 255 can be installed at the first water supply pipe 250 to control the supply of the water to the sump 200.

In some embodiments, at least one rack and spraying arm may be provided in the tub 110, such as inside the washing compartment 150, for example. When dishes are placed on the rack, the pump 210 pumps water and the spraying arm sprays the pumped water toward the rack. As shown, an upper rack 160 and a lower rack 170 can be disposed in an upper portion and a lower portion of the washing compartment 150, respectively. In addition, an upper spraying arm 230 and a lower spraying arm 220 can then be placed near the upper rack 160 and the lower rack 170 to spray the water pumped by the pump 210 at each respective rack. Washing compartment 150 may also include a top nozzle 240 in its upper portion to spray the water pumped by the pump 210 downward.

Dishwasher may include a steam generator 300 to supply steam to the washing compartment 150. Washing water may be circulated in the washing compartment 150 using the pump 210, and, for example, the lower spraying arm 220 and/or upper spraying arm 230. In some embodiments, steam generator 300 can be operated separately from the sump heater 290. As shown, the steam generator 300 may be in communication with the first water supply pipe 250. The steam generator 300 may be in communication with the washing compartment 150 via a steam supply pipe 280. A second water supply valve 265 may be installed at a second water supply pipe 260 to control the supply of the water to the steam generator 300.

Steam generator 300 can include a steam heater 310 for heating the water supplied to the steam generator 300 and a water level sensor 320 for sensing a water level inside the steam generator 300. The water level sensor 320 may sense a low level and a high level of water, for example. The low level can be predetermined or set to protect the steam heater 310 of the steam generator 300 and the high level can be predetermined or set to prevent the water supplied to the steam generator 300 from overflowing. In addition, the steam generator 300 may include a steam supply valve (not shown) for controlling the opening and closing of the steam supply pipe 280 so that the steam can be supplied to the washing compartment 150 at various times or intervals.

The sump 200 may include a pollution level sensor (not shown) in a predetermined portion of the sump 200, which measures a pollution level of the washing water circulated in the tub 110, for example. In an embodiment, the door 120 may include an exhaust fan 190 and an exhaust duct 192 to exhaust damp air from the washing compartment 150. In some embodiments, a control unit 102, which controls the dishwasher, may be operationally connected with the control panel 130, the pump 210, and the steam generator 300.

The controller 102 may control the dishwasher in accordance with predetermined instructions stored in a memory (not shown). The controller 102 may be operationally coupled with at least the control panel 130, the washing pump 210, and the steam generator 300 so that they may be operated in accordance with a user's selection on the control panel 130.

A variety of operational modes may be predetermined in the dishwasher. For example, an operational mode of the dishwasher may be determined based on a user's selection or a type of a dish. In addition, the operational mode may be determined based on a pollution or contamination level of a dish. Advantageously, when the operational mode(s) is determined, operating parameters, such as the number of rotations per minute of the motor or the amount of detergent can be selected based on the determined operational mode.

The method of controlling or operating the dishwasher may include performing a washing cycle (W), rinsing (R) cycle, and drying cycle. During the washing cycle (W), food scraps on the dishes can be removed. During the rinsing cycle (R), the dishes are rinsed. The rinsing cycle (R) may occur after the washing cycle (W). During the drying cycle, the moisture remaining on the dishes can be removed. In addition, smaller cycles may be performed within each of the washing, rinsing, or drying cycles and/or other cycles may be included.

Figure 2:
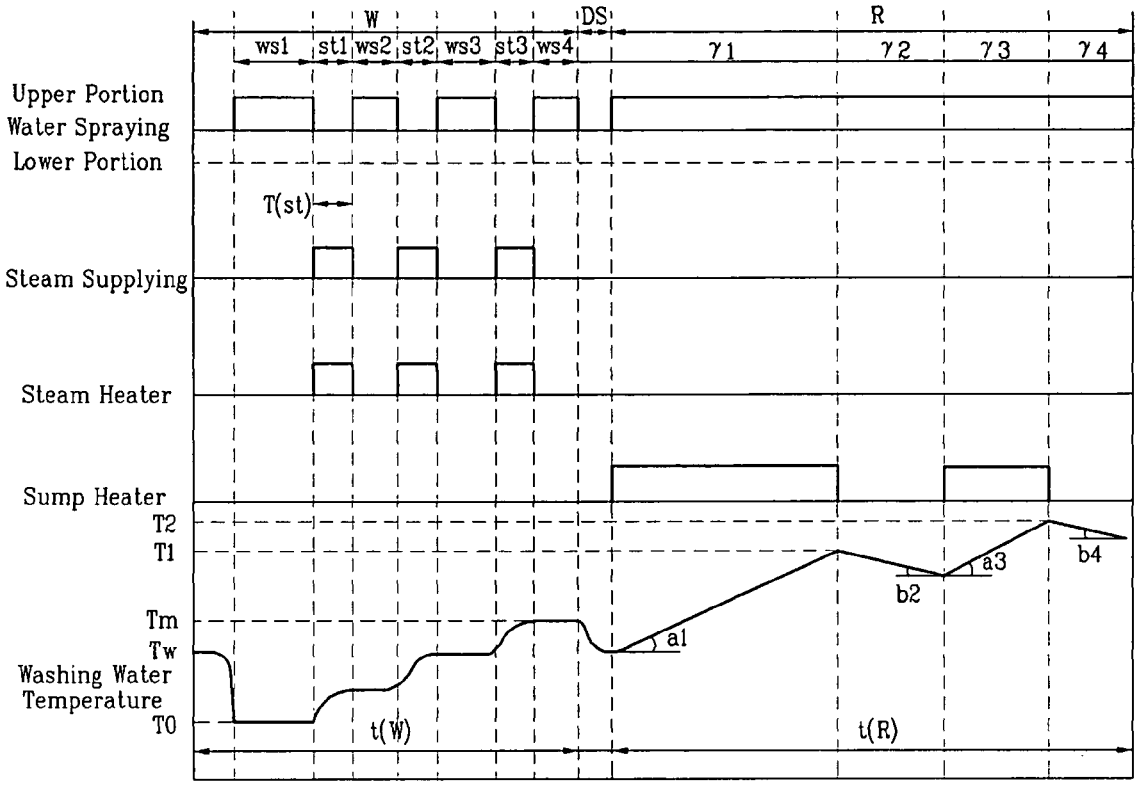
FIG. 2 illustrates overall operation of a dishwasher, according to an embodiment of the invention.

FIG. 2 illustrates overall operation of the dishwasher, according to an embodiment of the invention, including exemplary methods employed to control the operation of the dishwasher. Of note, the exemplary methods of operating the dishwasher can improve washing performance for sensitive dishes, such as wine glasses, which are more susceptible to damage or breakage. In some embodiments, washing water and detergent may be mixed and sprayed on to the dishes. In addition, the method may include preliminary washing of the sensitive dishes.

As noted above, the operation of the dishwasher may include a washing cycle (W), rinsing cycle (R), and a drying cycle. The washing (W) and rinsing (R) cycles can be used to remove contaminated matter, such as wine stains or lipstick spots on a wine glass. The upper rack 160 of the washing compartment 150 can include a structure capable of holding a plurality of dishes, such as wine glasses and cups. Generally, the washing cycle (W) involves use of the upper rack 160 to hold the dishes, the sump 200 that contains washing water, and the upper spraying arm 230 that sprays washing water. Of course, the lower spraying arm 220 and/or nozzle 240 may also, or alternatively, be used. The washing cycle (W) includes spraying water at the upper rack 160 from the upper spraying arm 230, which is provided in the upper portion of the washing compartment 150. This can improve the cleaning of sensitive dishes, which may be placed on the upper rack 160. In some embodiments, steam can also be supplied to the washing compartment 150 and directed at the upper rack 160 from the upper spraying arm 230. During the washing cycle (W), water can be drained which has been used and new clean water may be supplied (hereinafter "drained/supplied" or "DS") to the washing compartment 150 and/or sprayed.

As further shown in FIG. 2, during the washing cycle (W), steam can be supplied (hereinafter, "steam supplying") and water can be sprayed, for example by the upper spraying arm 230. Of note, steam supplying and water spraying may be repeated alternately or in other intervals.

Water can be supplied from an external water source. An external water source may include a city or household water system connected to first water supply pipe 250, and may also include the sump 200. The supplied water may be cold, room temperature, or heated to a predetermined temperature to reduce the washing time. In FIG. 2, water temperature may be denoted as (Tw). Of note, when the temperature of the sump 200 is lower than supplied warm water (from, for example, a household water system), the supplied water may be heat-exchanged with the sump 200 and the temperature of the water sprayed after being held in the sump 200 may decrease to a temperature (T0). After water is supplied, the upper spraying arm 230 can begin to spray water. In addition, when the steam generator 300 is pre-heated, the steam supplying may start prior to the spraying of water from the upper spraying arm 230.

With continued reference to FIG. 2, the steam generator 300 may supply steam at certain intervals or stages, such as st1, st2, st3, . . . , stn, for example. This steam supplying can occur repeatedly and may alternate with spraying of water from the upper spraying arm 230 at various intervals or stages, such as ws1, ws2, ws3, ws4, . . . , wsn. Because of steam being supplied, such as in interleaved intervals with spraying of water, the temperature of the washing water may increase.

In some embodiments, the steam can be supplied in more than three separate intervals (e.g., st1, st2, st3, . . . , stn) of the washing cycle (W). Of note, when each of the supply intervals or times in the steam supplying occurs regularly, the number of repeating times can be in proportion to a temperature increase range of the washing water. In an embodiment, the operation time (T(st)) of the steam supplying in which the steam generated by the steam generator 300 is supplied to the washing compartment 150, can be between approximately 3 and 5 minutes.

The water spraying intervals (ws1, ws2, ws3, ws4, . . . , wsn) and the steam supplying of the washing cycle (W) can be repeated until the temperature of the washing water reaches a preset temperature (Tm). In an embodiment, Tm can be in a temperature range between approximately 50° C. and 56° C. The temperature of the washing water may increase sequentially during steam supplying stages of the washing cycle (W). During steam supplying of the washing cycle (W) the sump heater 290 may be turned off. This can reduce electrical overload, or reduce the amount of power drawn by the dishwasher, when operating the steam generator 300 and the sump heater 290.

After the washing cycle (W) is substantially complete, the washing water can be drained and new clean water can be supplied (denoted by the letters "DS" on FIG. 2) for the rinsing cycle (R). Although the temperature of the washing water may increase during steam supplying stages of the washing cycle (W), the temperature of the water inside the sump 200 may decrease when the washing water is drained and the newly supplied water (DS) is introduced. In some embodiments, during the washing cycle (W) the washing water can be heated by the steam supplied to the washing compartment 150 by the steam generator 300 and or the sump heater 290.

During the rinsing cycle (R), the sump heater 290 can heat the water held in the sump 200. In addition, during the rinsing cycle (R) the sump heater 290 can be controlled so that the temperature of the rinsing or washing water reaches a preset first temperature (T1) and/or a preset second temperature (T2), which may be higher than the first preset temperature (T1). The first (T1) and second (T2) temperatures can be reached sequentially, for example. In addition, the water used to rinse the dishes may be heated in two stages such that the preset first temperature (T1) and the second temperature (T2) may be set as sequential maximum temperatures.

The rinsing cycle (R) can include heating the water in two stages using the sump heater 290 and spraying the heated water to the upper rack 160. During the two stage heating process, the water can be heated until the temperature of the water reaches the preset first temperature (T1) and then the sump heater 290 may be turned off. Then, the water can be re-heated (by turning on the sump heater 290 and/or injecting steam into the washing compartment 150) until the temperature of the water reaches the preset second temperature (T2) which can be higher than the preset first temperature (T1).

As noted above, water can be heated until the temperature of the water reaches the first temperature (T1) and the second temperature (T2) sequentially in the rinsing cycle (R). In addition, water can be heated in two stages where the first temperature (T1) and the second temperature (T2) can be set as the maximum temperatures. Because dishes may include food scraps and foreign matter that are decomposable at different temperatures and because washing efficiency can be enhanced by performing the drying cycle after the rinsing cycle (R), these control settings can substantially improve performance of the dishwasher.

For example, an optimal temperature for decomposing elements of lipstick on dishes is approximately 60° C. When the temperature of the water is over 65° C., for example, washing efficiency may deteriorate, however, drying time may be reduced. As a result, the first temperature (T1) may be set or predetermined to be between approximately 60° C. and 65° C. After the water is heated up to the first temperature (T1) and foreign matter is removed, the water can then be re-heated up to the second temperature (T2) to improve the drying efficiency during the following drying cycle. During the drying cycle, the temperature inside the washing compartment 150 may be increased to evaporate the moisture and the air within the washing compartment 150 may be exhausted from the washing compartment 150. In addition, the temperature of the dishes may be preheated by the water heated to the second temperature (T2).

In an exemplary embodiment, when dishes with wine stains or lipstick spotting are placed in the dishwasher, the first temperature (T1) selected may be between approximately 60° C. and 65° C. The second temperature (T2) selected may be between 66° C. and 69° C. The sump heater 290 can be controlled so that an increase oblique or rise (a1 and a3) of the temperature of the water is steeper when the sump heater is powered on than a decrease oblique or drop (b2 and b4) of the temperature of the water when the sump heater is powered off, as the rinsing water is heated during the two stages of the rinsing cycle (R). In FIG. 2, for example, the first stage of the rinsing cycle (R) may occur in the period spanned by γ1 and γ2, while the second stage of the rinsing cycle (R) may occur in the period spanned by γ3 and γ4.

With continued reference to FIG. 2, the water used in the rinsing cycle (R) can be heated until the temperature of the water sequentially reaches the first temperature (T1) and then the second temperature (T2) (which is higher than the first temperature T1). In addition, the water can be heated in the two stages such that the first temperature (T1) and the second temperature (T2) can be set as sequential maximum temperatures. In some embodiments, the sump heater 290 can heat the water used in the rinsing cycle (R) to the first temperature (T1) and then be turned off. The upper spraying arm 230 can then spray the water heated to T1 for a predetermined time period to rinse the dishes. The sump heater 290 can then be turned on again.

The washing cycle (W), or other cycles of the dishwasher, may be detergent-less, such that no detergent is used to wash the dishes. One factor which can affect the cleanliness of dishes resulting from the detergent-less washing cycle (W) can be the adequacy of the rinsing cycle (R). Thus, the dishwasher may advantageously perform the rinsing cycle (R) for a longer time period than the washing cycle (W), such that the overall washing time may be set so that the operation time of the washing cycle (t(W)) is shorter than the operation time of the rinsing (t(R)). Alternatively, in some embodiments the operation time of the washing cycle (t(W)) may be longer than the operation time of the rinsing cycle (t(R)).

In addition, the dishwasher may rinse the dishes using water which is warmed by the sump heater 290. As shown, the increase-oblique or gain (a1 and a2) of the water temperature in the periods when the sump heater is on (γ1 and γ3 of the rinsing cycle (R)) can be steeper than the decrease-oblique or drop (b2 and b4) of the water temperature in the periods when the sump heater is off (γ2 and γ4 of the rinsing cycle (R)). This may occur because when the sump heater 290 is turned off, water spraying can be performed without supplying the heat to the rinsing water. Thus, the water may cool more slowly. As a result, the sump heater 290 may be advantageously controlled so that the temperature of the water held in the sump 200 increases more rapidly than the temperature of the rinsing water decreases from its natural heat radiation.

Figure 3:
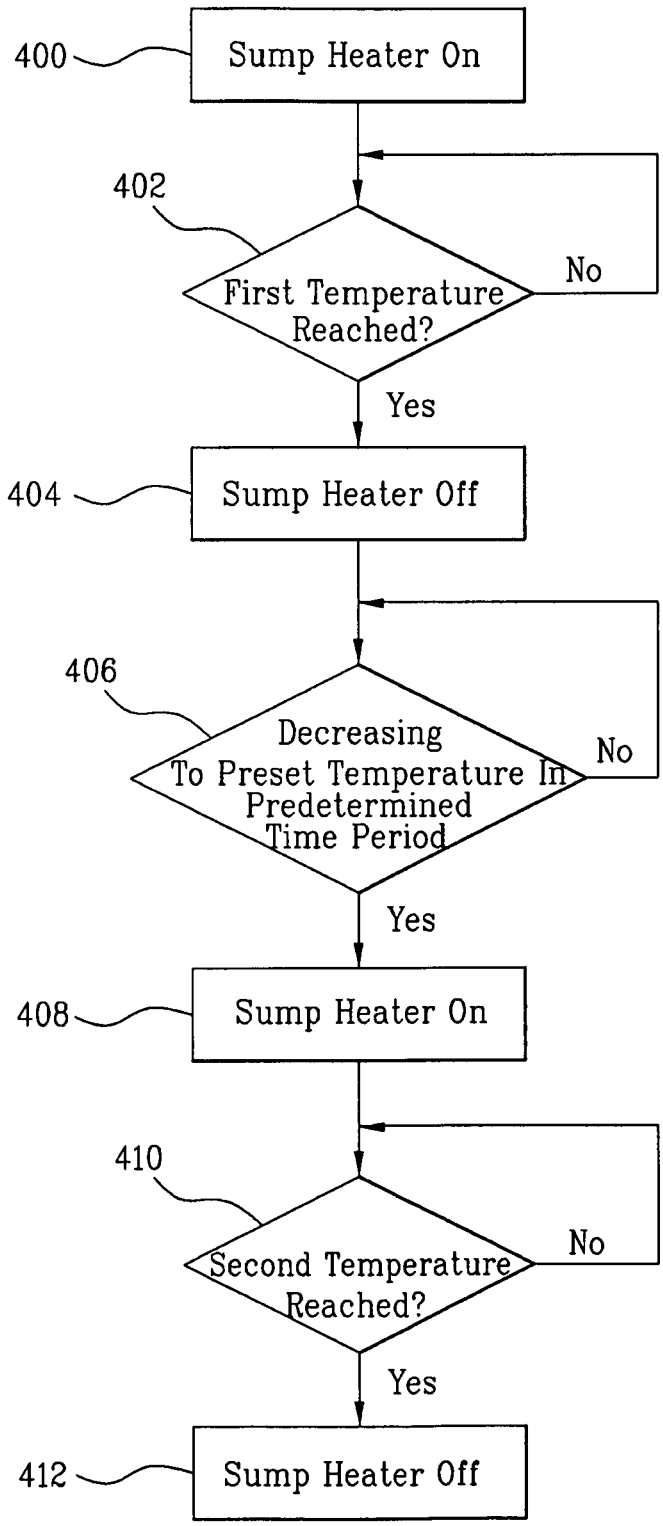
FIG. 3 illustrates an exemplary method of heating water during a rinse cycle, according to an embodiment of the invention.

FIG. 3 illustrates an exemplary method of heating water during a rinse cycle (R), according to an embodiment of the invention. As shown, the water may be heated in two stages although three or more stages of heating may occur. During the rinsing cycle (R), the sump heater 290 can be put into operation at the same time that rinsing water is sprayed by the upper spraying arm 230.

Beginning at 400, when the sump heater 290 is operating, the rinsing water stored in the sump 200 is heated. At 402, it is determined if the rinsing water has reached T1. At 404, if the temperature of the rinsing water (as measured, for example, by the temperature of the water in the sump 200) reaches the preset first temperature (T1), the sump heater 290 can then be controlled so that it is turned off (or its power is lowered). At 406, if a predetermined time period passes while the sump heater 290 is turned off and/or the temperature of the rinsing water or the sump 200 decreases below a preset temperature, then at 408, the sump heater 290 can then be turned on again (or its power increased). At 410, it is determined if the rinsing water has reached T2. If the temperature of the rinsing water rises to or above the preset second temperature T2 while the sump heater 290 is in a turned on state, then at 412 the sump heater 290 can then be turned off (or its power lowered) again. Of note, the rinsing water in the sump 200 may be heated in two stages, in which the second temperature (T2) is higher than the first temperature (T1).

It will be apparent to those skilled in the art that various modifications and variations can be made in the present disclosure without departing from the spirit or scope of the disclosure. Thus, it is intended that the present disclosure cover any modifications and variations within the scope of the appended claims and their equivalents.

What is claimed is:

1. A controlling method of a dishwasher comprising an upper rack, a sump for containing water, a sump heater for heating the water in the sump, and an upper spraying arm for spraying the water, the method comprising:

performing a washing cycle without detergent comprising:

spraying the water to the upper rack using the upper spraying arm located in an upper portion of a washing compartment having the upper rack therein, and supplying steam to the washing compartment, the spraying the water and the supplying steam being repeated alternately;

draining the water used in the washing cycle from the sump and supplying new water to the sump; and performing a single rinsing cycle without detergent, the rinsing cycle consisting of heating the new water in two stages while spraying the new water to the upper rack, wherein the sump heater is operated during the rinsing cycle increasing a temperature of the new water to a preset first temperature in a first stage and a preset second temperature, sequentially, in a second stage, wherein the preset second temperature is higher than the preset first temperature and lower than a steam temperature, wherein the temperature of the new water heated to the preset first temperature decreases before increasing again to the preset second temperature, and wherein no water is drained during the rinsing cycle.

2. The controlling method of claim 1, further comprising: not operating the sump heater while supplying steam in the washing cycle.

3. The controlling method of claim 1, wherein the supplying steam in the performance of the washing cycle is repeated more than three times.

4. The controlling method of claim 3, wherein the supplying steam in while performing the washing cycle continues for 3 to 5 minutes each time.

5. The controlling method of claim 1, wherein the first temperature is between 60° C. and 65° C.

6. The controlling method of claim 1, wherein the second temperature is between 66° C. and 69° C.

7. The controlling method of claim 1, wherein the rinsing cycle is longer than the washing cycle.

8. A controlling method of a dishwasher comprising a sump for containing water, a sump heater for heating the water in the sump, an upper spraying arm for spraying the water, and an upper rack located in an upper portion of a washing compartment, toward which the water is sprayed, the controlling method comprising:

performing a washing cycle without detergent comprising:

spraying the water to the upper rack from the sump through the upper spraying arm, and supplying steam to the washing compartment, the spraying the water and the supplying steam being repeated alternately;

draining the water used in the washing cycle and supplying new water to the sump;

heating the new water in the sump using the sump heater;

performing a single rinsing cycle without detergent, the rinsing cycle consisting of heating the new water in two stages, sequentially, while spraying new water heated by the sump heater to the upper rack; and performing a drying cycle to dry the contents of the washing compartment, wherein the two stages includes a preset first temperature as a first maximum temperature, and a preset second temperature, that is higher than the preset first temperature and lower than a steam temperature, as a second maximum temperature, wherein the temperature of the new water heated to the preset first temperature in the rinsing cycle decreases before increasing again to the preset second temperature, and wherein no water is drained during the rinsing cycle.

9. A controlling method of a dishwasher comprising a washing compartment including a sump for containing water, an upper spraying arm for spraying the water, and an upper rack located in an upper portion of the washing compartment, the controlling method comprising:

performing a washing cycle without detergent comprising:

spraying the water to the upper rack from the sump through the upper spraying arm, and supplying steam to the washing compartment, the spraying the water and the supplying steam being repeated alternately; and performing a single rinsing cycle without detergent consisting of:

heating water in the sump in two stages, sequentially, using a sump heater, while spraying heated water from the sump through the upper spraying arm to the upper rack, wherein heating water in the sump in two stages using a sump heater consists of:

turning on the sump heater and heating the water in the sump until a temperature of the water is a preset first temperature;

turning off the sump heater;

waiting a predetermined time period; and turning on the sump heater and heating the water until the temperature of the water is a preset second temperature, greater than the first temperature and less than a steam temperature, wherein no water is drained during the rinsing cycle.

10. The controlling method of claim 9, wherein heating water in the sump in two stages using a sump heater comprises:

controlling the sump heater to be turned on and off such that an increase-oblique of the temperature of the water while the sump heater is turned on is steeper than a decrease-oblique of the temperature of the water while the sump heater is turned off.

* * * * *